US006634684B2

(12) United States Patent
Spiessl

(10) Patent No.: US 6,634,684 B2
(45) Date of Patent: Oct. 21, 2003

(54) LATCHING MECHANISM FOR THE DOOR OF AN ELECTRIC HOUSEHOLD APPLIANCE

(75) Inventor: Georg Spiessl, Willhof (DE)

(73) Assignee: Elektromanufaktur Zangenstein Hanauer GmbH & Co. KGAA, Nabburg (DE)

( * ) Notice: Subject to any disclaimer, the term of this patent is extended or adjusted under 35 U.S.C. 154(b) by 0 days.

(21) Appl. No.: 09/909,372

(22) Filed: Jul. 19, 2001

(65) Prior Publication Data

US 2002/0017793 A1 Feb. 14, 2002

(30) Foreign Application Priority Data

Aug. 7, 2000 (DE) ..... 100 38 376

(51) Int. Cl.[7] ..... E05B 15/02

(52) U.S. Cl. ..... 292/341.16; 292/DIG. 69; 68/12.26; 134/57 DL

(58) Field of Search ..... 292/201, 341.16, 292/DIG. 66, DIG. 69; 70/10; 68/12.26; 134/57 DL, 58 DL

(56) References Cited

U.S. PATENT DOCUMENTS 3,602,015 A * 8/1971 Hughes ..... 68/12
3,892,933 A * 7/1975 Rocchitelli ..... 337/77
4,072,867 A * 2/1978 Goodlaxson ..... 307/118
RE30,263 E * 4/1980 Horvath ..... 292/341.16
4,286,811 A * 9/1981 Schantz ..... 292/201
4,623,179 A * 11/1986 Davis ..... 292/201
4,932,707 A * 6/1990 Ekstran ..... 292/341.17
5,009,456 A * 4/1991 Eck ..... 292/173
5,219,386 A * 6/1993 Kletzmaier ..... 70/277
5,551,187 A * 9/1996 Brouwer ..... 49/1

FOREIGN PATENT DOCUMENTS

EP 354275 * 2/1990 ..... H01H/71/02
EP 0965677 A1 12/1999

* cited by examiner

*Primary Examiner*—Gary Estremsky
(74) *Attorney, Agent, or Firm*—Clifford W. Browning

(57) ABSTRACT

A door latching mechanism for the door of an electric household appliance, in particular a washing machine, is described. The door latching mechanism comprises an element (34) of which at least a deflection part changes its spatial position (C, D) upon a change in temperature of the element (34) and thereby operates a bar element (32) for locking and unlocking the door. The door latching mechanism further comprises an electromagnetic device (46) comprising an actuating member (48) for unlocking the door. The actuating member (48) cooperates with an extension (40A) of the bar element (32).

15 Claims, 1 Drawing Sheet

LATCHING MECHANISM FOR THE DOOR OF AN ELECTRIC HOUSEHOLD APPLIANCE

BACKGROUND OF THE INVENTION

The invention relates to a door latching mechanism for the door of an electric household appliance, in particular, of a washing machine, with an element of which at least a deflection part changes its spatial position upon a change in temperature of the element and thereby operates a bar element for locking and unlocking the door, as well as an electromagnetic device for unlocking the door, which comprises an actuating member.

Door latching mechanisms in washing machines serve to prevent the user from opening the machine during or shortly after the washing operation and hurting himself/herself at the rotating drum or by spilling hot water.

In commercially available door locking systems, a movable hook is provided at the door of a washing machine. Said hook is supported in a pivot and is biased in its detent direction by means of a spring which causes the hook upon closing of the door to engage the housing of the door latching mechanism which is mounted in the front wall of the washing machine. For opening the door, same is provided with a door handle, with the door hook being moved in the opening direction when pulling at the door handle, leaving the detent position, so that the door can be pulled open.

Such a door locking mechanism is advantageous in that the door can be opened even if the machine is not connected with mains. Due to the fact that without further provisions the door could be opened any time, i.e. with the washing machine running, the door is locked by means of a door latching mechanism during operation of the washing machine.

There are two popular mechanisms of door latching systems in the market. The first one of these mechanisms employs a thermal element. In such an element, a deflection part, in most cases a free end of the element, changes its spatial position upon a change in the element's temperature, i.e. the element is bent. The mechanism is configured in such a manner that the door is locked upon this spatial change and unlocked upon the return into the original position.

Because the temperature of the element cannot be changed very rapidly, this mechanism exhibits a certain inertia upon locking and, in particular, upon unlocking. This means that after completion of the washing operating when the control unit of the washing machine provides for a temperature change and thus for unlocking of the door, the user has to wait very long until the door can be opened, even if the machine has come to a standstill.

The second popular mechanism in the market employs an electromagnet which causes a movement of a bar or slider by means of which the door is locked and unlocked. Here, the disadvantage of the thermal inertia is not given. In order to be able to open the door also in the case of a power failure, an additional mechanical emergency unlocking mechanism must be provided which is space-consuming and expensive.

From EP 0 965 677 A1 a door latching mechanism for the door of an electric household appliance is known. This door latching mechanism comprises a bimetal strip which, upon a change in temperature, varies its spatial position and thus actuates a bar element for locking and unlocking the door. The door latching mechanism further comprises an electric actuator with a solenoid and a movable actuating member. As soon as an electric current flows through the solenoid of the actuator, the actuating member cooperates with one end of a swivel arm.

The other end of the swivel arm then acts on the bar element in such a manner that the bolt element is brought from a locked position into an unlocked position. The door latching mechanism known from EP 0 965 677 A1 comprises a plurality of movable components and is therefore not only susceptible to failures but also involves high manufacturing costs.

This means that the marketable door latching mechanisms have drawbacks. It is the object of the invention to provide a door latching mechanism which does not exhibit these drawbacks.

SUMMARY OF THE INVENTION

In order to solve this object a door latching mechanism of the described type is developed in such a manner that the actuating member of the electromagnetic device immediately cooperates with the bar element or with an extension of the bar element. The inventive door latching mechanism has therefore fewer movable parts and thus a higher reliability.

The extension can be integrally formed with the bar element. Preferably, it is, however, part of a separate component which, for example, is connected with the bar element in such a manner that it extends in different directions starting from the bar element.

The actuating member can, for example, be a bolt which can be moved upon excitation or de-excitation of the electromagnetic device. If the actuating member cooperates immediately with the extension this is preferably formed as an extension of an intermediate member which, on the one side, is connected with the bar member and, on the other side, in particular via a compression spring with the deflection part of the element. The intermediate member may be a switching spring whose movement is limited by one or several stops.

A control unit is preferably provided which in the presence of an electric current, i.e. in the normal case, causes the door to be unlocked by means of the electromagnetic device comprising the electromagnet for opening, with the door being automatically unlocked by means of the element in the absence of an electric current, i.e. if the electromagnet and probably the control unit as well have failed.

According to the invention, the electromagnetic device must only unlock the door, but not lock it beforehand. The electromagnet may therefore be smaller or weaker, respectively, than with those mechanisms which in the state of the art employ an electromagnet for locking and unlocking. In particular, it can be a low-voltage or a fractional voltage magnet.

According to a preferred embodiment the electromagnet of the electromagnetic device upon its excitation will also unlock the door if it remained locked due to the change in position of the deflection part, i.e. upon the effect of the (thermal) element with the electromagnet not excited. The force action of the electromagnet is then quasi stronger than the thermal mechanism. This is advantageous in particular in cases where the washing machine it to be opened only briefly, for example to add laundry. It is then unlocked by means of the electro magnet while the thermal mechanism remains active. The door can be opened and closed shortly thereafter. After closing, the electromagnet is de-excited and the thermal mechanism can immediately relock the door.

The invention also provides a washing machine with a door latching mechanism of the above mentioned type.

According to a preferred embodiment, the washing machine comprises:

a means for interrupting a washing operation, which can be externally operated;

a sensor for sensing whether the door is open or closed; and a control unit which effects the unlocking of the door by the electromagnetic device upon an actuation of the means and which subsequently effects that the unlocking action is cancelled and the door is locked again by the element, if the sensor has either sensed that the door was opened and closed again, that it has remained closed longer than a certain period of time and/or that a start button was pressed.

This washing machine permits a later placement of laundry, as already mentioned above. The means for an interruption is, for example, a pause button. If the user presses this pause button, the drum of the washing machine will stop. The electromagnetic device unlocks the door immediately after standstill of the drum without having to wait for the elapse of the waiting time for unlocking through the thermal mechanism. It is not even necessary to adjust the temperature of the element in such a manner that the thermal mechanism would unlock the door. As already mentioned above, the electromagnet of the electromagnetic device can be designed in such a manner that its force action is stronger than that of the thermal mechanism locking the door.

The sensor now senses if the door is opened and closed again. Subsequently, the electromagnet is de-excited. Alternatively, this is done if the door has remained closed longer than a certain time period (which is measured, for example, by means of a clock provided in the washing machine). It can also be provided that in addition a start button or another means is operated.

After the de-excitation of the electromagnet the thermal mechanism is activated again, and the still activated thermal mechanism can lock the door again, respectively. The washing operation can then be continued.

In the following, a preferred embodiment will be described with reference to schematic drawings in which:

DETAILED DESCRIPTION OF A PREFERRED EMBODIMENT

Figure 1:
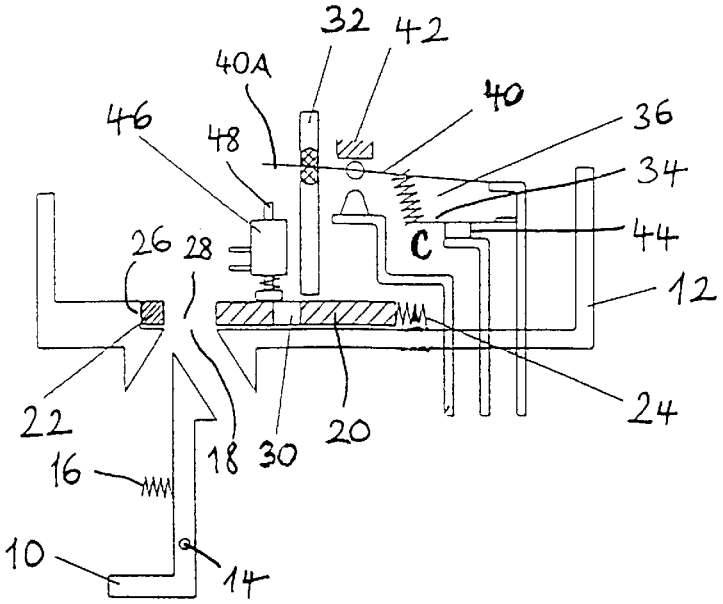
FIG. 1 shows a cross-section through an inventive door latching mechanism with the door open and the latching mechanism unlocked.

At first, FIG. 1 shows a cross-section through an inventive door latching mechanism, with the door being open and the door latching mechanism being unlocked.

With the door in the open position, a door hook 10 is outside the housing 12 of the latching mechanism, which is arranged in the front wall of a washing machine.

The door hook 10 is supported in a pivot point 14 and is biased by a spring 16 (FIG. 1) to the right. The housing 12 is provided with an opening 18 into which the door hook 10 plunges upon closing. In addition, a main slide 20 with a stop part 22 is provided in the housing, which is biased by a spring 24 in such a manner that the stop part 22 abuts against a stop 26 in the housing. The main slide 20 has an opening 28 into which the door hook 10 also plunges upon closing and which is congruent with the opening 18 in the housing. The main slide also comprises a locking window 30 into which a bar element in the form of a blocking slide 32 plunges for locking which, however, in the position shown in FIG. 1 is located laterally above the locking window 30.

A thermal locking and unlocking mechanism comprises a bimetal spring 34 which in FIG. 1 is in position C and which exerts pressure via a compression spring 46 onto an intermediate member in the form of a switching spring 40. The switching spring 40 has a fixed end and a movable end. In areas of the movable end of the switching spring 40 said spring is connected with the blocking slide 32 in such a manner that a free arm of the switching spring 40 extends off the blocking slide 32 towards the fixed end of the switching spring 40. The free end of the switching spring 40 serves as an extension 40A of the blocking slide 32. By acting on the extension 40A the blocking slide 32 can perform a swivel motion about the fixed end of the switching spring 40.

The switching spring 40 is a bifurcated leaf spring, with the bimetal spring 34 deforming upon heating and moving through the fork with one free end, while the other end of the bimetal spring 34 is secured in the housing.

In order to prevent the switching spring 40 and the blocking slide 32 from being urged too far upwards, a stop 42 is provided for limiting their movement.

In the position shown in FIG. 1 the bimetal spring is cold, i.e. a PTC resistor 44 providing for heating same is not energised.

Furthermore, an electromagnetic device 46 comprising an electromagnet is provided as part of the door latching mechanism. The electromagnet which moves a bolt 48 is a fractional voltage or low-voltage magnet and thus consumes little space. In the position shown in FIG. 1 the electromagnet is de-excited and the bolt 48 is therefore in a lower position. In lieu of such an electromagnet a hinged-armature magnet can be provided.

Upon closing the door, the door hook 10 plunges through the openings 18 and 28 into the housing 12 and the main slide 20, with the spring 16 being stronger than the spring 24 and thus urging the door hook 10 together with the main slide to the right (in the figures) so that subsequently, the locking window 30 is located immediately below the blocking slide 32. The door is now closed, but not locked, i.e. it can be opened again.

For locking the door, the PTC resistor 44 is energised. This causes the bimetal spring 34 to bend upwards through the fork of the switching spring 40 into position D shown in FIG. 2 and to press the switching spring 40 with the blocking slide 32 via the compression spring 36 downwards in the figure, with the blocking slide plunging into the locking window 30 in the main slide 20. Thereby the switching spring 40 abuts against the NO contact 50.

Figure 2:
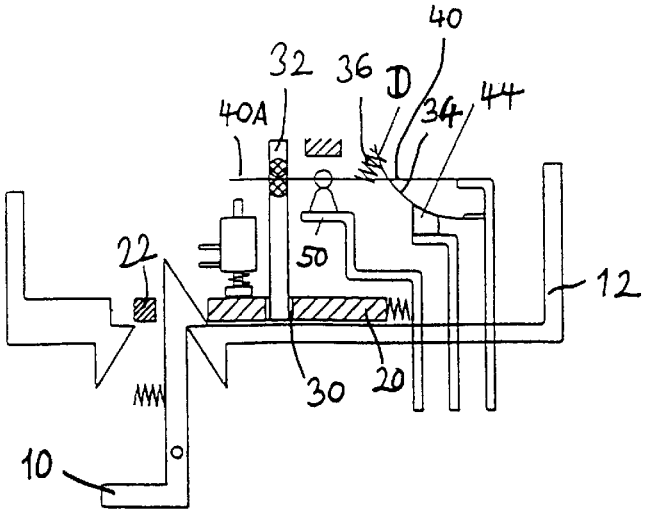
FIG. 2 shows a cross-section of the inventive door latching mechanism with the door closed and locked.

In the position shown in FIG. 2 the door is now closed, the stop part 22 of the main slide 20 blocks a movement of the hook out of the door latching mechanism.

If the current supply to the PTC resistor 44 were interrupted now, the thermal mechanism with the bimetal spring 34, the compression spring 36, and the switching spring 40 as well as the blocking slide 32 would return into the position shown in FIG. 1 after cooling down of the bimetal spring 34.

Figure 3:
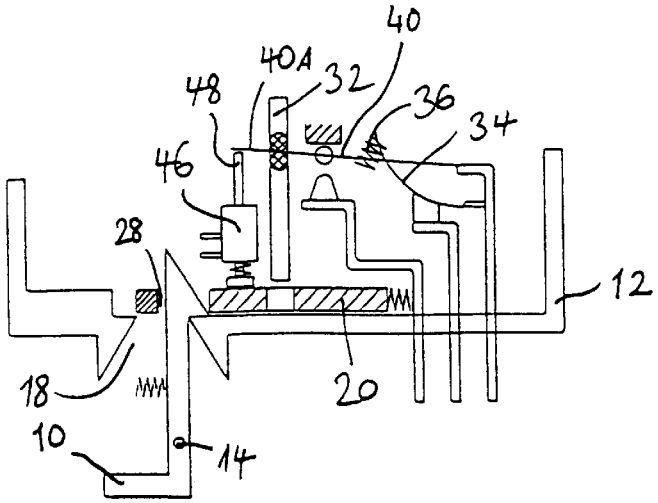
FIG. 3 shows a cross-section through an inventive door latching mechanism with the door closed and electrically unlocked.

Because a user has to wait a long time until the door is unlocked although, for example, the drum of the washing machine is already at a standstill, the electromagnet of the electromagnetic device 46 is excited. As shown in FIG. 3, the bolt 48 of the electromagnet then pushes the extension 40A and thus the blocking slide 32 upwards in the figure, regardless of the fact that it urges the bimetal spring 34 together with the compression spring 36 downwards in the figure, i.e. the electromagnet of the electromagnetic device 46 exerts a higher force on the other side of the switching spring 40 than the bimetal spring 34 with the compression spring 36 on the one side. The door is now unlocked; by a rotation of the door hook in the bearing 14 the main slide 40 is urged to the left in the figure, and the door hook 10 can be pulled out of the openings 28 and 18, the door is opened again.

Simultaneously with the excitation of the electromagnet of the electromagnetic device 46 the current supply to the PTC resistor 44 is interrupted so that the bimetal spring 34 with the compression spring 36 returns into position C shown in FIG. 1.

As soon as the latter is the case the electromagnet can be deexcited, and the bolt 48 returns into the position shown in FIG. 1.

With the inventive system, the user of the washing machine does therefore no have to wait until the thermal mechanism of the door has done the unlocking because this is effected by means of the electromagnetic device 46. Although the door cannot be unlocked by the electromagnet in the case of a power failure, it will automatically be unlocked by the thermal mechanism because the PTC resistor is no longer energised and thus the position shown in FIG. 1 is reached again. In this case, unlocking of the door takes somewhat longer, but no additional mechanic unlocking means is required.

The inventive door latching mechanism exhibits high user safety. With the electromagnetic latching mechanisms available in the market a high expenditure in the control of the electronics is required because the door is unlocked by a short noise pulse in the control unit, or with another construction type, the door latchings can even be opened immediately. The user could then be injured by the rotating drum. In the inventive door latching mechanism, the door will be briefly unlocked by a short noise pulse, but at the end of the noise pulse immediately locked again, so that such a hazard cannot occur.

What is claimed is:

1. A washing machine, comprising:

a door, and a door latching mechanism for the door of the washing machine, the door latching mechanism comprising an element (34) of which at least a deflection part changes its spatial position (C, D) upon a change in temperature of the element (34) and thereby operates a bar element (32) for locking and unlocking the door, as well as an electromagnetic device (46) comprising an actuating member (48) for unlocking the door, wherein the actuating member (48) directly cooperates with the bar element (32).

2. A washing machine, comprising:

a door, and a door latching mechanism for the door of the washing machine, the door latching mechanism comprising an element (34) of which at least a deflection part changes its spatial position (C, D) upon a change in temperature of the element (34) and thereby operates a bar element (32) for locking and unlocking the door, as well as an electromagnetic device (46) comprising an actuating member (48) for unlocking the door, wherein the actuating member (48) cooperates with an extension (40A) of the bar element (32).

3. The washing machine according to claim 1 or 2, wherein the door latching mechanism is characterized by a control unit which causes that the door can be unlocked for opening by means of the electromagnetic device (46), with the door being unlockable by means of the element (34) in the absence of an electric current.

4. The washing machine according to claim 1 or 2, wherein the door latching mechanism is characterized in that the position of the bar element (32) can be changed by a change in position (C, D) of the deflection part of the element (34), and the electromagnetic device (46) also effects a change in the position of the bar element (32).

5. The washing machine according to claim 1 or 2, wherein the door latching mechanism is characterized in that the bar element (32) is formed as a blocking slide and upon locking engages a locking window (30) of a main slide (20), in order to prevent a movement of the main slide (20), whereby the release of a door hook (10) at the door is precluded.

6. The washing machine according to claim 1 or 2, wherein the door latching mechanism is characterized in that a compression spring (36) is arranged at the deflection part of the element (34), which acts on the bar element (32) via an intermediate member (40) arranged at the bar element (32).

7. The washing machine according to one of claim 2, wherein the door latching mechanism is characterized in that the actuating member is formed as a bolt (48) or a hinged armature and the electromagnetic device (46) effects a movement of the bolt (48) or the hinged armature which acts on the bar element (32) via the extension (40A).

8. The washing machine according to one of claim 7, wherein the door latching mechanism is characterized in that the compression spring (36) on the one side of the bar element (32) and the bolt (48) or the hinged armature on the opposite side of the bar element (32) acts on the intermediate member (40).

9. The washing machine according to one of claim 6, wherein the door latching mechanism is characterized in that the intermediate member is a switching spring (40).

10. The washing machine according to one of claim 6, wherein the door latching mechanism is characterized in that at least one stop (42) limits the movement of the intermediate member (40).

11. The washing machine according to claim 1 or 2, wherein the door latching mechanism is characterized in that the element (34) consists of a bimetal element.

12. The washing machine according to one of claim 1, wherein the door latching mechanism is characterized in that the deflection part of the element (34) is a free end of same, while the element (34) with its opposite end is secured at the door latching mechanism.

13. The washing machine according to claim 1 or 2, wherein the door latching mechanism is characterized in that a temperature change of the element (34) is produced by means of a PTC resistor (44) operatively coupled to the element (34).

14. The washing machine according to claim 1 or 2, wherein the door latching mechanism is characterized in that the electromagnetic device (46) upon its excitation unlocks the door if it remained locked due to the change in position (D) of the deflection part with the electromagnetic device (46) not excited.

15. The washing machine according to claim 1 or 2, further comprising:

a means for interrupting a washing operation, which can be externally operated;

a sensor for sensing whether the door is open or closed; and a control unit which effects the unlocking of the door by the electromagnetic device (46) upon an actuation of the means and subsequently effects that the unlocking action is can-celled and the door is locked again by the element (34), if the sensor has either sensed that the door was opened and closed again, that it has remained closed longer than a certain period of time and/or that a start button was pressed.

* * * * *